US006907850B2

(12) United States Patent
Creel

(10) Patent No.: US 6,907,850 B2
(45) Date of Patent: Jun. 21, 2005

(54) INTERNAL COMBUSTION ENGINE AND METHOD OF ENHANCING ENGINE PERFORMANCE

(76) Inventor: Hardie D. Creel, 129 Cree Ct., Gray, LA (US) 70359

( * ) Notice: Subject to any disclaimer, the term of this patent is extended or adjusted under 35 U.S.C. 154(b) by 83 days.

(21) Appl. No.: 10/453,402

(22) Filed: Jun. 3, 2003

(65) Prior Publication Data

US 2004/0244736 A1 Dec. 9, 2004

(51) Int. Cl.[7] ..... F02B 33/10
(52) U.S. Cl. ..... 123/71 R
(58) Field of Search ..... 123/71 R, 51 B, 123/73 C, 73 R, 73 A, 70 R, 73 AF

(56) References Cited

U.S. PATENT DOCUMENTS

| | | | | |
|---|---|---|---|---|
| 2,295,978 A | * | 9/1942 | Toce et al. | 123/71 R |
| 5,730,099 A | | 3/1998 | Gillespie | |
| 5,732,548 A | | 3/1998 | Peter-Hoblyn | |
| 5,762,040 A | | 6/1998 | Taipale et al. | |
| 5,791,304 A | | 8/1998 | Taipale | |
| 6,170,443 B1 | | 1/2001 | Hofbauer | |
| 6,209,495 B1 | | 4/2001 | Warren | |

FOREIGN PATENT DOCUMENTS

| | | |
|---|---|---|
| EP | 1039113 | 9/2000 |

OTHER PUBLICATIONS

Niquette, Paul, "The Bourke Engine" adapted from *101 Words I Don't Use*, Sophisticated: The Magazine (1997) *available at* http://www.niquette.com/books/sophmag/bourke.htm.

* cited by examiner

*Primary Examiner*—Henry C. Yuen
*Assistant Examiner*—Hyder Ali
(74) *Attorney, Agent, or Firm*—John H. Runnels; Bennie J. Davis; Andre J. Porter

(57) ABSTRACT

An apparatus and method to enhance the overall performance of engines in one or more of the following ways: by increasing the power output; by reducing the level of unwanted atmospheric emissions; and by reducing engine wear. The apparatus is an engine (e.g., 2-stroke or 4-stroke, diesel or gasoline-fueled internal combustion engine) comprising a crankshaft, crankcase, combustion chamber, oil pan, piston, connecting rod, intake port, exhaust port, and scavenging pump assembly having an air cylinder and an air diaphragm. The scavenging pump assembly allows for the control of air and fuel intake port pressure by controllably boosting an intake mixture of fuel and air to a level sufficiently greater than ambient pressures, and loading the mixture into the combustion chamber, while minimizing the potential for engine lubricating-oil to combine with the intake air-fuel mixture.

29 Claims, 4 Drawing Sheets

INTERNAL COMBUSTION ENGINE AND METHOD OF ENHANCING ENGINE PERFORMANCE

This invention pertains to an apparatus and method to enhance the overall performance of engines (e.g., diesel and gasoline-fueled internal combustion engines) in one or more of the following ways: by reducing engine wear; by increasing the power output; or by reducing the level of unwanted atmospheric emissions.

Emission problems for engines (e.g., 2-stroke and 4-stroke internal combustion engines) are a major environmental and public health concern. For example, studies have shown that conventional marine engines (outboard and personal watercraft engines) contribute about 12% of the total hydrocarbon or atmospheric pollutants ("HC") emitted into the atmosphere by mobile sources. In 1998, the Environmental Protection Agency ("EPA") established stringent HC emission standards for marine engines to be implemented over a nine year period. The new standards require that all manufacturers of outboard and personal watercraft engines produce engines with 75% lower HC emissions by 2006. See United States Environmental Protection Agency—Air and Radiation—Office of Transportation and Air Quality, "Reducing Air Pollution from Non-road Vehicles," EPA420-F-00-048, November 2000.

While 4-stroke internal-combustion engines ("4-stroke engines") generally produce lower HC emissions than 2-stroke internal-combustion engines ("2-stroke engine"), conventional marine engines are preferably 2-stroke engines because of the reduced weight, construction simplicity, and higher power output. The functional difference between conventional 2-stroke and 4-stroke engines is in the number of piston strokes required to complete a power cycle, i.e., to intake a mixture of fuel and air ("intake stroke"), compress and ignite the mixture to produce a "power stroke," then exhaust the combusted gases ("exhaust stroke"). Most engines have a crankshaft, combustion chamber, piston and connecting rod. In a conventional 2-stroke engine, significant quantities of unburned fuel (approximately 25–30%) bypass the combustion chamber and escape to the atmosphere, because a single stroke is used to exhaust combusted gases and recharge the combustion chamber for the next power stroke. More specifically, in 2-stroke engines, the air-fuel mixture enters the combustion chamber through inlet ports during the intake stroke. The piston then compresses the mixture until it is ignited by a spark plug, producing the power stroke. (In the case of a diesel-fueled internal combustion engine, ignition will occur when the diesel fuel is injected into the combustion chamber and comes into contact with superheated air.) As the piston retracts, an exhaust port is opened and combusted fuel exits the combustion chamber. While the combusted fuel exits the combustion chamber, a new air-fuel mixture is loaded into the combustion chamber through inlet ports. Each time a new air-fuel mixture is loaded, a portion of it exits with the combusted fuel. Furthermore, most 2-stroke marine engines use a scavenging system in which the air-fuel mixture is loaded into the crankcase, compressed in the crankcase, and then routed from the crankcase to the combustion chamber as the piston retracts into the crankcase. Mists of lubricating oil from the crankcase mix with the air-fuel mixture as it is loaded into the combustion chamber. This increases the amount of lubricating oil contained in the combustion chamber, which increases the amount of HC and other components that exit with the combusted fuel, including raw fuel. See U.S. Pat. No. 5,732,548; and European Patent Application No. 1,039,113.

U.S. Pat. No. 6,209,495 describes a compound two stroke engine that uses two straight-through connecting rods to tie together two pistons in horizontally-opposed cylinders. A a rotary drive is connected to an output shaft and to the two connecting rods to translate the linear motion produced by the pistons to rotary motion.

U.S. Pat. No. 6,170,443 describes a two-stroke internal combustion engine that uses a single crankshaft and two opposed cylinders having opposed inner and outer pistons reciprocally disposed to improve engine efficiency.

EPO. Pat. Application No. 1,039,113 describes a two-cycle internal combustion engine that uses a reciprocally movable scavenging pump to purify exhaust gas and enhance the output power and the specific fuel consumption.

U.S. Pat. No. 5,730,099 describes a two-stroke engine and method to promote reduction in engine exhaust emissions, comprising a combustion chamber, a fuel injector, an ignition system, an exhaust system, and a pump to periodically pump air unmixed with fuel into the combustion chamber.

U.S. Pat. No. 5,732,548 describes a method for reducing harmful emissions from two stroke engines while maintaining catalytic efficiency, comprising the steps of adding a platinum group metal compound to the cylinder of a two-stroke engine having a catalytic oxidizer; igniting fuel in a cylinder in the presence of the platinum group metal compound; and passing the exhaust gas containing the platinum group metal through an exhaust duct and the catalytic oxidizer.

U.S. Pat. Nos. 5,762,040 and 5,791,304 describe two-cycle internal combustion engines having low-pressure, cylinder wall fuel injection systems that reduce the potential of short circuiting unburned fuel through the engine exhaust port by optimizing the direction of fuel injection into the piston cavity.

An unfilled need exists for an apparatus and method to enhance the overall performance of engines (e.g., diesel or gasoline-fueled internal combustion engines) in one or more of the following ways: by reducing engine wear; by increasing the power output; or by reducing the level of unwanted atmospheric emissions.

I have discovered an apparatus and method to enhance the overall performance of engines by increasing the power output, reducing the amount of unwanted atmospheric emissions, or both. Compared to prior devices and methods that enhance the performance of engines, the novel apparatus and method also reduces engine wear. The apparatus is an engine (e.g., diesel or gasoline-fueled internal combustion engine) comprising a crankshaft, crankcase, oil pan, combustion chamber, piston, connecting rod, intake port, exhaust port, and scavenging pump assembly having an air cylinder and an air diaphragm. The connecting rod converts the reciprocal motion of the piston to rotational motion of the crankshaft. The scavenging pump assembly allows for the control of air and fuel intake port pressure by controllably boosting an intake mixture of air and fuel to a level sufficiently greater than ambient pressures, and loading the air-fuel mixture into the combustion chamber, while minimizing the potential for engine lubricating-oil to combine with the intake air-fuel mixture. Typically, the air-fuel mixture is loaded into the air cylinder using a carburetor system. However, air and fuel may be separately supplied to the combustion chamber using a fuel injector system. In this instance, air is supplied to the combustion chamber via the scavenging pump assembly, while fuel is supplied to the combustion chamber via the fuel injector system.

In a preferred embodiment, the scavenging pump assembly additionally allows for the reduction of engine wear as compared to that inherently caused by prior scavenging pumps actuated by the rotational movement of the crankshaft. This is achieved by relying on the reciprocal movement of the piston to colinearly actuate the air diaphragm. In this embodiment, the piston and air diaphragm are colinearly aligned and rigidly connected, using an air diaphragm connecting member that passes through the crankcase, such that as the piston compresses a loaded air-fuel mixture in the combustion chamber, it causes the air diaphragm to simultaneously draw an air-fuel mixture into the air cylinder without interfering with or relying on the rotation of the crankshaft. When the loaded mixture ignites, the piston reciprocally retracts from the combustion chamber, causing the air diaphragm to supply the new mixture to the combustion chamber through a routing assembly that routes the new mixture from the air cylinder directly to the combustion chamber, without exposing the new mixture to engine lubricating-oil contained in the crankcase and oil pan.

The general purpose of this invention is to provide a reliable, inexpensive apparatus and method that enhances the overall performance of engines (e.g., 2-stroke and 4-stroke, diesel and gasoline-fueled internal combustion engines). The invention may be used to improve the performance of engines empowering various devices, including outboards, personal water craft, tillers, chainsaws, air blowers, weed-eaters, motorcycles, all-terrain vehicles, automobiles, trucks, etc. In a preferred embodiment, the basic design of the apparatus is that of a conventional, 2-stroke internal combustion engine (diesel or gasoline-fueled), having a crankshaft, crankcase, oil pan, combustion chamber, piston, intake port, exhaust port, and connecting rod. The mechanical components should be capable of withstanding the heat produced internally during the operation of the engine, and should have a relatively high mechanical strength, and a relatively high resistance to corrosion, friction, and wear, such as aluminum, cast iron, steel, titanium, polytetrafluoroethylene, and graphite composites. To enhance the overall engine performance, the basic design further comprises a scavenging pump assembly capable of controllably supplying the combustion chamber with an air-fuel mixture relatively free of lubricating-oil from the crankcase, and pressurizing the air-fuel mixture to a level sufficiently greater than ambient pressures without interfering with or directly relying on the rotation of the crankshaft.

There are several advantages to using the novel scavenging pump assembly to supply the combustion chamber with an air-fuel mixture. First, the number of components may be minimal. Fabrication may be simple and inexpensive. Second, the potential for mechanical failure of the crankshaft is reduced. The air diaphragm is colinearly aligned and rigidly fixed to the piston, and thus is actuated by movement of the piston rather than the crankshaft. Third, the design of the novel scavenging pump assembly allows for the increased power output of an engine without having to increase the overall size of the engine or any of its major components (e.g., the crankshaft, crankcase, combustion chamber, piston, or connecting rod). Fourth, the design of the novel scavenging pump assembly allows for the increased ability to maintain a sufficient level of lubricating-oil in the crankcase to lubricate meshing engine components. Fuel and air may be mixed in an air cylinder separate from the crankcase, and then routed to the combustion chamber, minimizing exposure to engine lubricating-oil contained in the crankcase. Finally, the potential for raw fuel to escape the combustion chamber during the exhaust stroke may be nearly eliminated. Air-fuel mixture loading can be delayed to provide sufficient time for the exhaust port to close.

Figure 1:
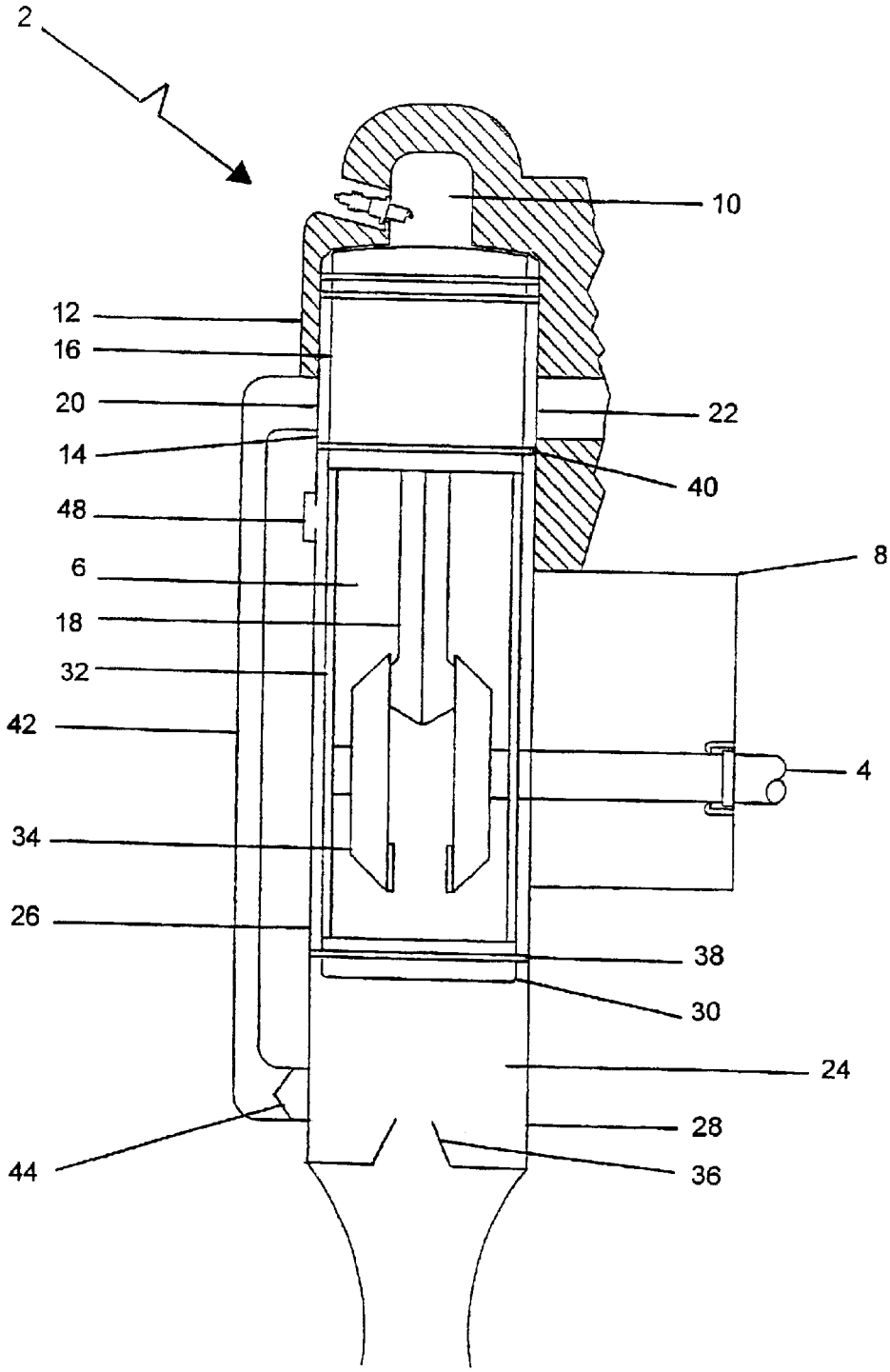
FIG. 1 illustrates a cross-sectional, schematic diagram of some of the parts of one embodiment of the internal combustion engine.
Figure 2:
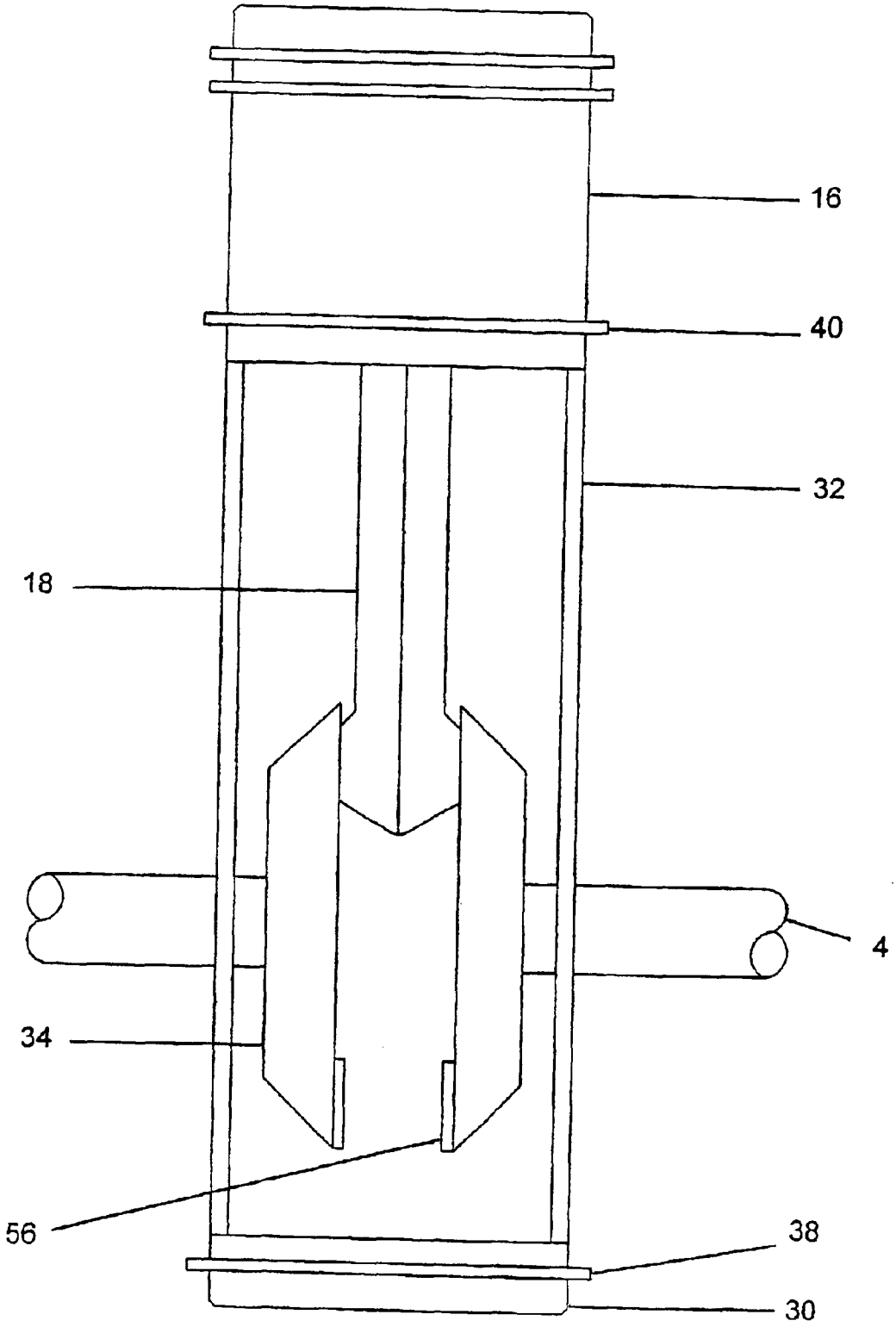
FIG. 2 illustrates a schematic diagram of a side plan view of one embodiment of the air diaphragm driving assembly.

FIG. 1 illustrates one embodiment of an internal combustion engine 2 in accordance with the present invention. This embodiment comprises a crankshaft 4, a crankcase 6, an oil pan 8 a combustion chamber 10 having a distal end 12 and a proximal end 14, a piston 16 disposed in combustion chamber 10, a connecting rod 18, intake port 20, exhaust port 22, and a scavenging pump assembly. The scavenging pump assembly comprises an air cylinder 24 having a distal end 26 and a proximal end 28, and an air diaphragm 30 disposed in air cylinder 24, and a routing assembly (described below). To minimize mechanical wear caused by friction, the scavenging pump assembly additionally comprises an air diaphragm connecting member for colinearly and rigidly connecting piston 16 to air diaphragm 30. (In this embodiment, crankcase 6 and oil pan 8 maintained a sufficient amount of lubricating-oil in engine 2 to keep all of the major components of engine 2 lubricated, including combustion chamber 10 and air cylinder 24.) The air diaphragm connecting member comprised two pairs of stilts 32 that passed through crankcase 6, near counterweight balancers 34. See FIG. 2. The dimensions and shape of stilts 32 were such that piston 16 was capable of driving air diaphragm 30 without directly relying on or interfering with the rotation of crankshaft 4 or counterweight balancers 34. See FIG. 2. Modifications to counterweight balancers 34 (e.g., reduction of the total width of counterweight balancers 34) may be required, so that stilts 32 can pass through crankcase 6 without interfering with the rotation of crankshaft 4 or movement of counterweight balancers 34. Any adverse effects (e.g., crankshaft 4 balance offsets) caused by such modifications may be overcome by adding weights 56 onto the inside of counter-weight balancers 34 to rebalance crankshaft 4. See FIG. 2.

As illustrated in FIG. 1, air cylinder 24 was located opposite combustion chamber 10 and included a one-way valve assembly capable of restricting the flow of intake air-fuel mixture entering air cylinder 24 from a carburetor (not shown), such as an intake reed 36 (10202 FF series Lawn-Boy engine-Outboard Marine Corporation, Waukegan, Ill.). The dimensions and shape of the contact surface of air cylinder 24 complemented that of air diaphragm 30 such that when air diaphragm 30 was advanced towards proximal end 28 of air cylinder 24, it compressed the intake air-fuel mixture to a level greater than ambient pressures, and prevented engine-lubricating oil contained in crankcase 6 from contaminating the air-fuel mixture in air cylinder 24. In a preferred embodiment, air diaphragm 30 had a seal ring 38 centrally located to allow for a relatively air tight seal between air diaphragm 30 and air cylinder 24. Seal ring 38 helped minimize the potential for lubricating-oil escaping into air cylinder 24. Optionally, to further minimize the potential for lubricating-oil to escape into air cylinder 24, the surface of air diaphragm 30, adjacent to crankcase 6, can be made concave to allow for the gathering of lubricating-oil away from seal ring 38. To help minimize the potential for lubricating-oil to escape into combustion chamber 10, a seal ring 40 may added to piston 16 to form a relatively tight seal between piston 16 and combustion chamber 10.

As illustrated in FIG. 1, to further minimize the potential for contaminating the air-fuel mixture with engine lubricating-oil, the routing assembly comprised four externally-located routing pipes 42 (only one routing pipe 42 is shown) that routed the air-fuel mixture from air cylinder 24 directly to the combustion chamber 10, without exposing the mixture to the lubricating-oil in the crankcase 6. Optionally, a check valve 44 (Model No. 2-9280; Echlin, Inc., Branford, Conn.) may be used to maximize the flow of air-fuel mixture supplied to combustion chamber 10, and to prevent any negative pressure formed by air cylinder 24 during the compression stroke from affecting the air-fuel mixture in routing pipe 46. See FIG. 3C. (Seal ring 40 also may help reduce the potential for negative pressure affecting the air-fuel mixture in routing pipes 42.) Raw fuel emissions may be nearly eliminated by holding the air-fuel mixture in routing pipe 42 and releasing it when exhaust port 22 is closed. This may be accomplished using a solenoid valve (not shown) located in routing pipe 42 near intake port 20, and capable of periodically allowing the air-fuel mixture in routing pipe 42 to enter combustion chamber 10 after piston 16 has reached proximal end 14 and exhaust port 22 has closed. In an alternative embodiment, a system comprising at least one intake valve (i.e., a valve located at intake port 20 and capable of inhibiting the flow of air-fuel mixture into combustion chamber 10; not shown), at least one exhaust valve (i.e., a valve located at exhaust port 20 and capable of inhibiting the flow of exhaust out of combustion chamber 10; not shown), and a camshaft (not shown) with lobes capable of periodically opening and closing the intake valve and exhaust valve, if present, as piston 16 is actuated may be used to minimize raw fuel emissions.

As illustrated in FIG. 1, routing pipe 42 extended from a point near proximal end 28 of air cylinder 24, between check valve 44 and air diaphragm 30 (when air diaphragm 30 is farthest from distal end 26 of air cylinder 24), to intake port 20 located near proximal end 14 of combustion chamber 10, between distal end 12 of combustion chamber 10 and piston 16 (when piston 16 is farthest from distal end 12 of combustion chamber 10). In an alternative embodiment, engine lubricating-oil contamination may be nearly avoided by routing the compressed mixture from air diaphragm 30 into combustion chamber 10 through hollow stilts 32 that form an isolated passageway from air cylinder 24 to combustion chamber 10 via crankcase 6. To allow for a sufficient amount of lubricating-oil to remain in combustion chamber 10 and air cylinder 24 to reduce mechanical wear caused by friction, crankcase 6 should be exposed to the atmosphere using a vent 48 or vacuum (not shown).

Figure 3B:
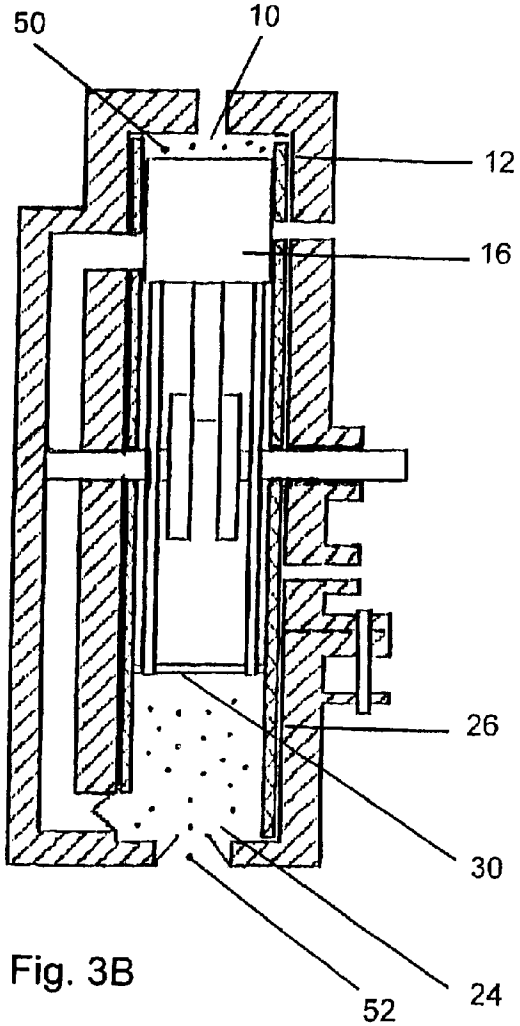
FIG. 3B illustrates a cross-sectional, schematic diagram of some of the parts of one embodiment of the scavenging pump during the power stroke.
Figure 3A:
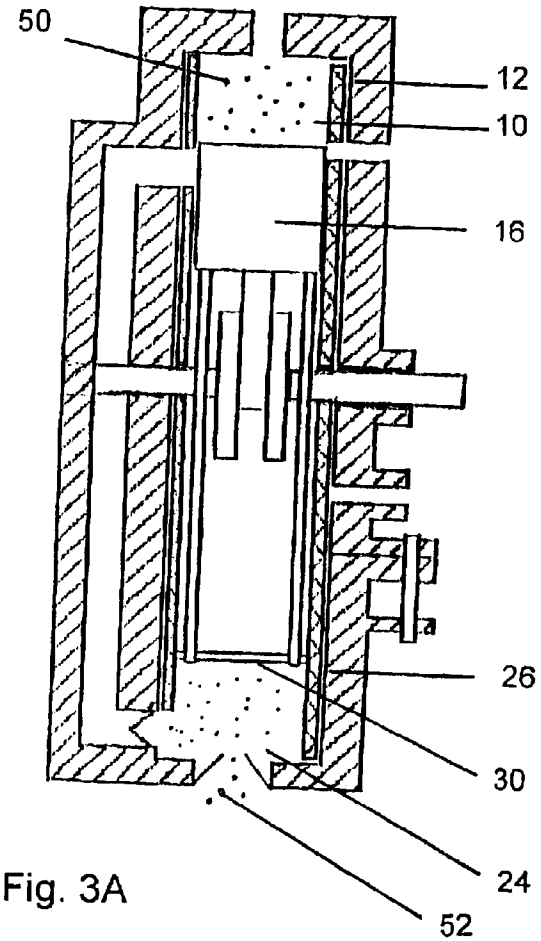
FIG. 3A illustrates a cross-sectional, schematic diagram of some of the parts of one embodiment of the scavenging pump during the compression stroke.
Figure 3D:
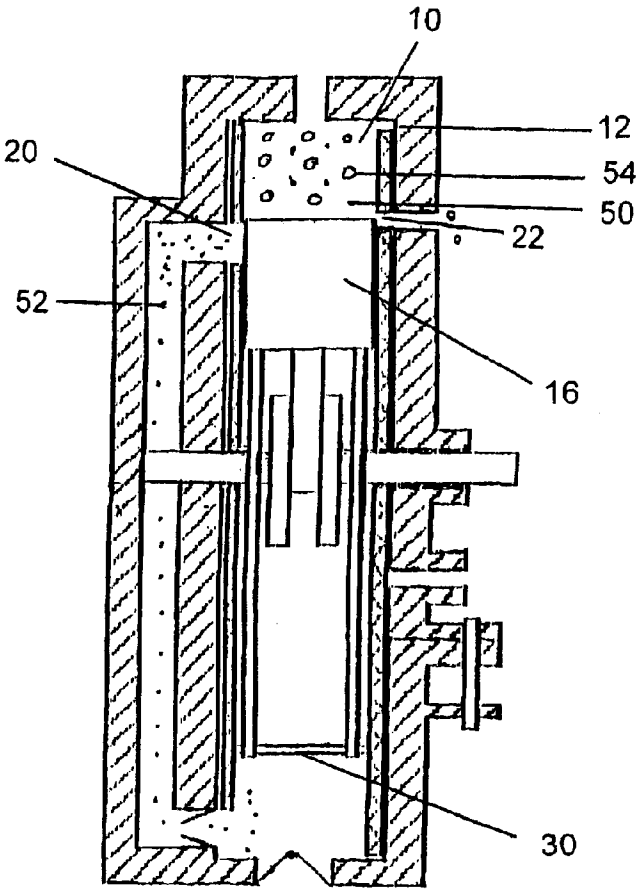
FIG. 3D illustrates a cross-sectional, schematic diagram of some of the parts of one embodiment of the scavenging pump during the exhaust stroke.
Figure 3C:
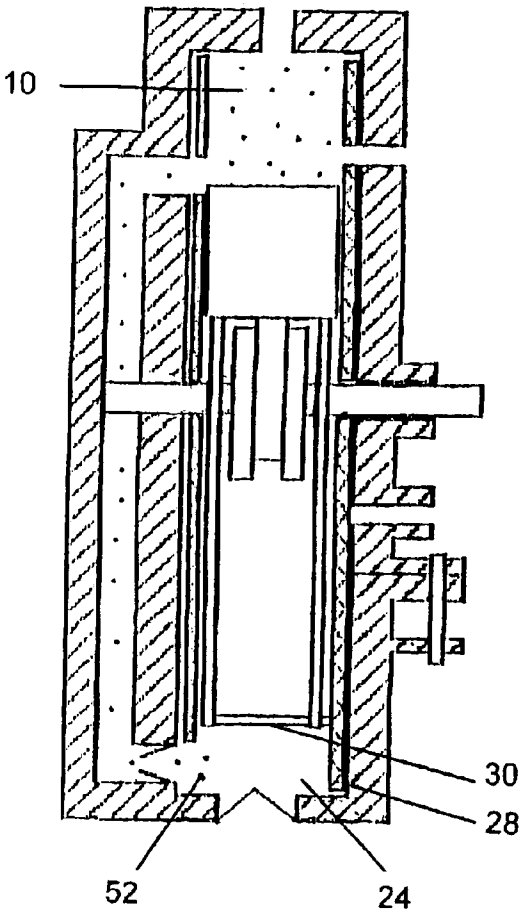
FIG. 3C illustrates a cross-sectional, schematic diagram of some of the parts of one embodiment of the scavenging pump during the intake stroke.

FIGS. 3A–3D illustrate schematic diagrams of one embodiment of the engine as air diaphragm 30 is actuated by piston 16. As shown in FIGS. 3A and 3B, as piston 16 advanced towards distal end 12 of combustion chamber 10 to compress and ignite a loaded air-fuel mixture 50, it simultaneously pulled air diaphragm 30 towards distal end 26 of air cylinder 24, drawing an intake air-fuel mixture 52 into air cylinder 24. Optionally, fuel may be separately supplied to combustion chamber 10 via a fuel injection system (not shown). As shown in FIG. 3C, when air diaphragm 30 advanced towards proximal end 28 of air cylinder 24, it compressed intake air-fuel mixture 52 to a level sufficiently greater than ambient pressures, to begin loading combustion chamber 10. As shown in FIG. 3D, when loaded air-fuel mixture 50 ignited, piston 16 retracted from distal end 12 of combustion chamber 10 allowing an ignited air-fuel mixture 54 to exit exhaust port 22 just before air diaphragm 30 drove intake air-fuel mixture 52 into combustion chamber 10 through intake port 20.

EXAMPLE 1

Construction of a Prototype

A 4.75 horsepower 10202 FF series Lawn-Boy engine 2 (engine specifications: 2-stroke, gasoline-fueled, internal combustion; 2.375 in bore size; 1.75 in stroke size; 121 cc displacement; 19 lb engine weight; Outboard Marine Corporation, Waukegan, Ill.) having a crankshaft 4, crankcase 6, oil pan 8, combustion chamber 10, piston 16, and connecting rod 18 was removed from a lawmnower and modified by adding a scavenging pump assembly, as schematically illustrated in FIG. 1. Most of the major engine components were made of aluminum, except crankshaft 4, which was made of steel. Air diaphragm 30 was 2.371 in dia. and had a standard, combustion seal ring 38 for a 2.375 in dia. engine bore centrally located to allow for a relatively tight seal between air diaphragm 30 and air cylinder 24. A standard, combustion seal ring 40 for a 2.375 in dia. bore was also added to piston 16 to allow for a relatively tight seal between combustion chamber 10 and piston 16.

Air diaphragm 30 and piston 16 were reciprocally positioned and rigidly connected together with four, 6.0 inch long, 0.25 in dia. aluminum stilts 32. Stilts 32 were placed at the edges of both air diaphragm 30 and piston 16. Counter-weight balancers 34 on crankshaft 4 were modified by reducing the total width from 1.70 in to 1.30 in to provide a clearance of approximately 0.035 in between counter-weight balancers 34 and adjacent stilts 32.

Air cylinder 24 had a diameter slightly greater (approximately 0.004 in) than air diaphragm 30 to allow for a relatively tight seal between air diaphragm 30 and air cylinder 24. Intake reed 36 (Outboard Marine Corporation, Waukegan, Ill.) was placed near proximal end 28 of air cylinder 24 to prevent intake air-fuel mixture 52 entering air cylinder 24 through the carburetor from escaping back into the carburetor during the power stroke.

Routing pipes 42 were made of 0.375 in dia. stainless steel pipe.

In initial tests, the prototype was mounted on a lawnmower chassis and run for several hours. The prototype produced abnormal engine vibrations. After dismantling the prototype, it was determined that as air diaphragm 30 advanced towards distal end 26 of air cylinder 24, a negative pressure was being generated in routing pipes 42, which interrupted the flow of intake air-fuel mixture 52 to combustion chamber 10. In addition, it was determined that intake port 20 over extended into crankcase 6 allowing for the generation of a negative pressure in the crankcase 6. It was also determined that modifications to counter-weight balancers 34 offset the balance of crankshaft 4.

To reduce the adverse effects of negative pressure, a check valve 44 (Model No. 2-9280; Echlin, Inc., Branford, Conn.) was inserted in routing pipes 42, and crankcase 6 was exposed to the atmosphere using a vent 48 to prevent loaded air-fuel mixture 50 from being vacuumed out routing pipe 42 and lubricating-oil from being vacuumed out of crankcase 6. Additionally, weights 56 were placed on the inside of counter-weight balancers 34 to balance crankshaft 4 and reduce engine vibrations. See FIG. 2.

Preliminary observations suggest that the air diaphragm connecting member (i.e., stilts 32) effectively used the movement of piston 16 to colinearly actuate air diaphragm 30 without interfering with crankshaft 4 or counterweight balancers 34. In addition, air diaphragm 30 and air cylinder 24 isolated the intake air-fuel mixture 52 from lubricating-oil contained in crankcase 6, and pressurized intake air-fuel mixture 52 before driving it to combustion chamber 10 via routing pipes 42.

In the future, additional tests will be conducted to confirm that the air diaphragm and air cylinder isolate the intake mixture of air and fuel from lubricating oil contained in the crankcase and reduce engine wear. Future tests will also determine alternative means for balancing the crankshaft, the effects of ambient pressure on the crankcase, and volumetric efficiency in the intake port(s) and air cylinder, in addition to determining how significant the scavenging pump assembly increases engine horsepower output, reduces unwanted atmospheric emissions, or both.

This scavenging pump assembly may be adapted to improve the performance of almost any internal combustion engine, including diesel and gasoline-fueled engines, by adjusting the shape and dimensions of the air cylinder, air diaphragm, air diaphragm driving assembly, and routing assembly, in addition to adjusting the supply timing of air and fuel into the combustion chamber. The scavenging pump assembly may also be used for multi-cylinder engines by adding additional air cylinders, air diaphragms, air diaphragm driving assemblies and routing assemblies.

The complete disclosures of all references cited in this specification are hereby incorporated by reference. In the event of an otherwise irreconcilable conflict, however, the present specification shall control.

I claim:

1. An engine capable of internally combusting a mixture of air and fuel, comprising:

(a) at least one combustion chamber having at least one intake port and at least one exhaust port;

(b) a piston disposed in said combustion chamber;

(c) at least one crankshaft;

(d) a crankcase for housing said crankshaft and maintaining a sufficient amount of lubricating oil in said engine to reduce mechanical wear caused by friction;

(e) at least one connecting rod connecting said piston to said crankshaft, and converting reciprocal motion of said piston into rotational motion of said crankshaft;

(f) at least one scavenging pump assembly comprising an air cylinder and an air diaphragm disposed in said air cylinder; wherein said air diaphragm and said air cylinder are colinearly aligned with said piston and said combustion chamber; wherein said air diaphragm is colinearly actuated by said piston, without interfering with the movement of said crankshaft, using an air diaphragm connecting member that passes through said crankcase, adapted to rigidly connect said air diaphragm to said piston; wherein when said piston performs a compression stroke, said piston causes said air diaphragm to produce a negative pressure in said air cylinder and to draw in intake air or an intake mixture of air and fuel; wherein when said piston performs an intake stroke, said piston causes said air diaphragm to controllably pressurize the intake air or intake mixture of air and fuel; and wherein said air diaphragm additionally comprises at least one seal ring adapted to provide a relatively tight seal between said air diaphragm and said air cylinder to isolate the intake air or intake mixture of air and fuel from lubricating-oil contained in the crankcase; and (g) at least one muting assembly adapted to route the intake air or intake mixture of air and fuel in said air cylinder to said combustion chamber, without exposing the intake air or the intake mixture of air and fuel to the lubricating oil contained in said crankcase.

2. An engine as recited in claim 1, wherein said air diaphragm driving member comprises at least one pair of stilts.

3. An engine as recited in claim 2, wherein said stilts are hollow.

4. An engine as recited in claim 1, wherein said air cylinder additionally comprises a one-way valve assembly adapted to restrict the flow of the intake air or intake mixture of air and fuel in said air cylinder.

5. An engine as recited in claim 4, wherein said one-way valve assembly comprises at least one intake reed.

6. An engine as recited in claim 1, wherein said routing assembly comprises at least one routing pipe.

7. An engine as recited in claim 6, wherein said routing pipe additionally comprises a check valve for preventing the intake air or intake mixture of air and fuel from escaping as it is supplied to said combustion chamber.

8. An engine as recited in claim 1, wherein said piston additionally comprises at least one seal ring adapted to provide a relatively tight seal between said combustion chamber and said piston, and to prevent lubricating-oil from escaping into said combustion chamber.

9. An engine as recited in claim 1, wherein said engine power a device selected from the group consisting of outboards, personal water crafts, tillers, chainsaws, air blowers, weed-eaters, motorcycles, all-terrain vehicles, automobiles, and trucks.

10. An engine as recited in claim 1, wherein said engine is a two-stroke internal combustion engine.

11. An engine as recited in claim 1, wherein said engine has higher power output than an otherwise identical engine lacking said scavenging pump assembly.

12. An engine as recited in claim 1, wherein said engine has lower hydrocarbon emissions than an otherwise identical engine lacking said scavenging pump assembly.

13. An engine as recited in claim 1, wherein said engine has lower lubricating oil emissions than an otherwise identical engine lacking said scavenging pump assembly.

14. An engine as recited in claim 1, wherein said engine is a four-stroke internal combustion engine.

15. A method for internally combusting a mixture of fuel and air in an engine comprising:

(a) introducing a mixture of fuel and air into an engine comprising at least one crankshaft; at least one crankcase; at least one combustion chamber; at least one piston; at least one connecting rod; at least one intake port; at least one exhaust port; and at least one scavenging pump assembly; wherein the scavenging pump assembly additionally comprises an air cylinder and an air diaphragm disposed within the air cylinder; wherein the piston and the air diaphragm are colinearly aligned with the piston and the combustion chamber; wherein the air diaphragm is colinearly actuated by the piston, without interfering with the movement of the crankshaft, using an air diaphragm connecting member that passes through the crankcase, and is adapted to rigidly connect the air diaphragm to the piston; and wherein the air diaphragm additionally comprises at least one seal ring adapted to provide a relatively tight seal between the air diaphragm and the air cylinder to isolate intake air or an intake mixture of air and fuel from lubricating-oil contained in the crankcase;

(b) pressuring the intake air or the intake mixture of air and fuel in the air cylinder by igniting a loaded and compressed mixture of fuel and air in the combustion chamber; and (c) isolating and delivering pressurized intake air or intake mixture of air and fuel from the air cylinder to the combustion chamber by routing the intake air or intake mixture of air and fuel from the air cylinder to the combustion chamber using a routing assembly.

16. A method as recited in claim 15, additionally comprising repeating steps (a) through (c).

17. A method as recited in claim 15, wherein the air diaphragm driving member comprises at least one pair of stilts.

18. A method as recited in claim 17, wherein the stilts are hollow.

19. A method as recited in claim 15, wherein the air cylinder additionally comprises a one-way valve assembly adapted to restrict the flow of the intake air or intake mixture of air and fuel in the air cylinder.

20. A method as recited in claim 19, wherein the one-way valve assembly comprises at least one intake reed.

21. A method as recited in claim 15, wherein the routing assembly comprises at least one routing pipe.

22. A method as recited in claim 21, wherein the routing pipe additionally comprises a check valve for preventing the intake air or intake mixture of air and fuel from escaping as it is supplied to the combustion chamber.

23. A method as recited in claim 15, wherein the piston additionally comprises at least one seal ring adapted to provide a relatively tight seal between the combustion chamber and the piston, and to prevent lubricating-oil from escaping into the combustion chamber.

24. A method as recited in claim 15, wherein the engine is used to power a device selected from the group consisting of outboards, personal water crafts, tillers, chainsaws, air blowers, weed-eaters, motorcycles, all-terrain vehicles, automobiles, and trucks.

25. A method as recited in claim 15, wherein the engine is a two-stroke internal combustion engine.

26. A method as recited in claim 15, wherein the engine has higher power output than an otherwise identical engine lacking the scavenging pump assembly.

27. A method as recited in claim 15, wherein the engine has lower hydrocarbon emissions than an otherwise identical engine lacking the scavenging pump assembly.

28. A method as recited in claim 15, wherein the engine has lower lubricating oil emissions than an otherwise identical engine lacking the scavenging pump assembly.

29. A method as recited in claim 15, wherein the engine is a four-stroke internal combustion engine.

* * * * *